US006851213B1

(12) United States Patent
Doiron

(10) Patent No.: US 6,851,213 B1
(45) Date of Patent: Feb. 8, 2005

(54) TRIGGER LOCK

(76) Inventor: Gerald J. Doiron, 867 Chestnut Ct., Marco Island, FL (US) 34145-2307

( * ) Notice: Subject to any disclaimer, the term of this patent is extended or adjusted under 35 U.S.C. 154(b) by 0 days.

(21) Appl. No.: 10/662,804

(22) Filed: Sep. 15, 2003

Related U.S. Application Data

(62) Division of application No. 09/783,652, filed on Feb. 14, 2001, now Pat. No. 6,629,379.

(51) Int. Cl.[7] ..... F41A 17/00

(52) U.S. Cl. ..... 42/70.11; 42/70.06

(58) Field of Search ..... 42/70.11, 70.01, 42/70.06, 70.07

(56) References Cited

U.S. PATENT DOCUMENTS

| | | | | | |
|---|---|---|---|---|---|
| 2,387,669 | A | * | 10/1945 | Loomis | 42/70.06 |
| 2,563,720 | A | * | 8/1951 | Guisasola | 42/70.02 |
| 4,300,301 | A | * | 11/1981 | Morrison | 42/70.06 |
| 4,754,568 | A | * | 7/1988 | Brandt | 42/70.06 |
| 5,025,582 | A | * | 6/1991 | Mote, Sr. | 42/70.06 |
| 5,465,517 | A | * | 11/1995 | Garofalo | 42/70.06 |
| 5,903,994 | A | * | 5/1999 | Tange | 42/70.01 |

* cited by examiner

*Primary Examiner*—Michael J. Carone
*Assistant Examiner*—M. Thomson

(57) ABSTRACT

A trigger lock is shown which rotates from a fire position in which the trigger can operate and to a no-fire position in which the trigger cannot operate. The lock is located primarily within the frame. A thumb lever or a key can be used to engage the trigger lock to rotate the trigger lock from the fire to the no-fire position and vice versa.

6 Claims, 8 Drawing Sheets

TRIGGER LOCK

This application is a divisional of application Ser. No. 09/783,652, filed Feb. 14, 2001 now U.S. Pat. No. 6,629, 379.

FIELD

The present version of this invention relates generally to the field of devices used to deter the use of weapons by those unauthorized to use them by preventing the trigger from firing.

BACKGROUND

This invention relates to devices to deter the use of weapons by those unauthorized to use them, and more particularly to devices that engage a trigger of a weapon or device to deter the weapon or device from operation unless the operator has the key to allow the trigger of the weapon or device to operate.

Weapons such as handguns, rifles, shotguns, cross-bows and others generally are activated or fired by using a trigger. The trigger generally operates with various linkages that interact with elements of the weapon causing the weapon to fire. The operation of the weapon trigger largely depends on the type of weapon. There can be a danger if someone unauthorized to operate the weapon gains access to the weapon and is able to "fire" the weapon especially if the weapon is loaded.

Devices other than weapons that have triggers could benefit from a device that would selectively fix the trigger in a fire or operation and no-fire or no-operation position.

This unauthorized operator may not realize that the weapon is loaded or may not understand how to correctly and safely operate or handle the weapon. They may just be careless with the weapon and not realize at is loaded. No matter what the issues are relating to safety, another safety device or additional device likely to lessen the likelihood of accidents and unauthorized users of weapons would be welcome.

Generally hand guns and other weapons have some type of "safety" devices. These devices engage some portion of the weapon and prevent the weapon from firing when these devices are in the no-fire position. Many of these devices are well known in the prior art and consist of various manually operated levers or buttons which put the weapon selectively in the no-fire or fire positions.

The problems with some types of devices are that they can be defeated or manipulated rather easily so that the weapon can be put in the fire position without much effort or intellect. Some of these devices can arm a weapon if the lever or button is caught on clothing or bumped while the weapon is being carried or stored. While these devices may be appropriate for careful responsible adult users, these devices are not the best for curious children.

Children often times are intrigued by weapons and may not fully understand the danger of handling a weapon especially if the weapon is left loaded. They are many times capable of pushing buttons or levers and have a curious nature when it comes to weapons.

Many types of other devices exist and are well know in the art such as transmitter type rings and locks that clamp over the trigger and prevent operation of the tiger. While separate devices that lock the trigger can be effective, there are problems in that the devices detach from the weapon and can be misplaced or dropped in the snow or mud. It these devices come in two or more pieces that can become detached from one another, this contributes to the possibility of loss. This can be a dis-incentve to replacing the device on the weapon once removed, thus endangering unauthorized persons when the device is not replaced. Other clip or attachment type devices suffer from similar disadvantages.

Another disadvantage of the attachable type devices is that many only attach to one side of the weapon and must be oriented to the weapon to be attached property. This can make them difficult to reattach to the weapon in low light, the dark or with gloves or mittens.

Another disadvantage to these types of devices is that they must be stored somewhere when removed while the weapon is in the fire position. The storage spot will many times be the users pocket which can be bulky and uncomfortable. In bush conditions the device could possibly fall out and become lost. The user could also put the device down once removed, and this raises the possibility of forgetting it if they were to leave in a hurry. There are weight issues too that can arise for one who is hiking or hunting and needs to carry gear that is of minimal weight.

Another disadvantage of other devices is that they can make holstering the weapon in a standard holster difficult. This is due to the shape and size of some of the art. One would need a custom holster or harness to carry a weapon with some of the art devices.

In view of the disadvantages to the devices known in the art there is a need for a device that stays affixed to the weapon, is of light weight, is relatively easy to operate and yet provides protection from unauthorized users.

For the foregoing reasons, there is a need for a trigger lock device that deters the operation of a trigger on a weapon or device by unauthorized users.

SUMMARY

In view of the foregoing disadvantages inherent in the prior art for selectively locking and unlocking weapons there is a need for a device that is fixedly attached to the weapon and requires a key to selectively lock and unlock the trigger such that the weapon with be in the no-fire and fire positions respectively according to the authorized users wishes. There is also a need for a thumb lever type device that can naturally place the weapon in the fire position with the thumb when the user removes it from a holster.

A first object of the invention is to provide a device that can selectively position a weapon trigger in the fire and no-fire positions.

Another object of the invention is to provide a device that requires a key to position the weapon trigger in the fire and no-fire positions.

It is yet another object of the invention to provide a device that is difficult to defeat without a key.

It is a still further object of the invention to provide a device that will discourage the un-authorized user from operating the weapon.

It is another object of the invention to provide a device that is aesthetically appealing and does not deter from the weapon profile.

It is another object of the invention to provide a device that has a thumb lever to conveniently place the weapon in the fire position.

Another object of the invention is to provide a device that is built into the weapon to alleviate the problems associated with separable attachable devices It is another object of the invention to provide a device that is relatively inexpensive and easy to manufacture.

Another object of the invention is to provide a device with a thumb lever that rotates to place the weapon in a fire and no-fire position.

Another object of the invention is to provide a device that is relatively easy to place in the no-fire position and requires a positive action to put the weapon in the fire position.

These together with other objects of this invention, along with various features of novelty which characterize this invention, are pointed out with particularity in the claims annexed hereto and forming a pan of this disclosure. For a better understanding of this invention, its operating advantages and the specific objects attained by its uses, references should be had to the accompanying drawings and descriptive matter in which there is illustrated a preferred embodiment of this version of the invention.

DETAILED DESCRIPTION OF THE PREFERRED EMBODIMENTS

Figure 1:
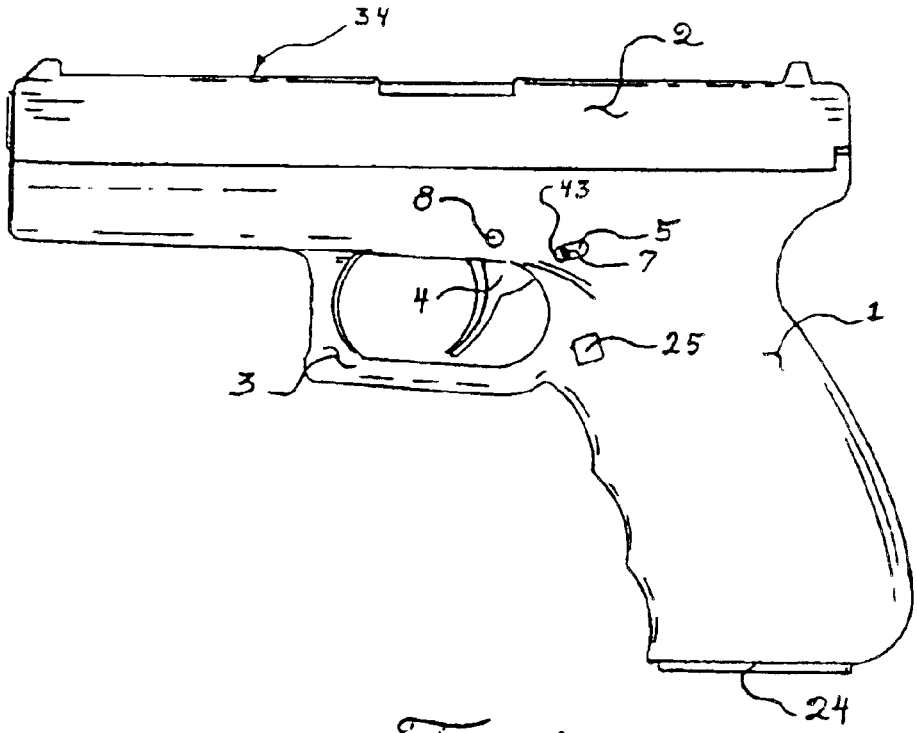
FIG. 1 shows a left side view of a handgun with one embodiment of the invention showing one location of the device.
Figure 2:
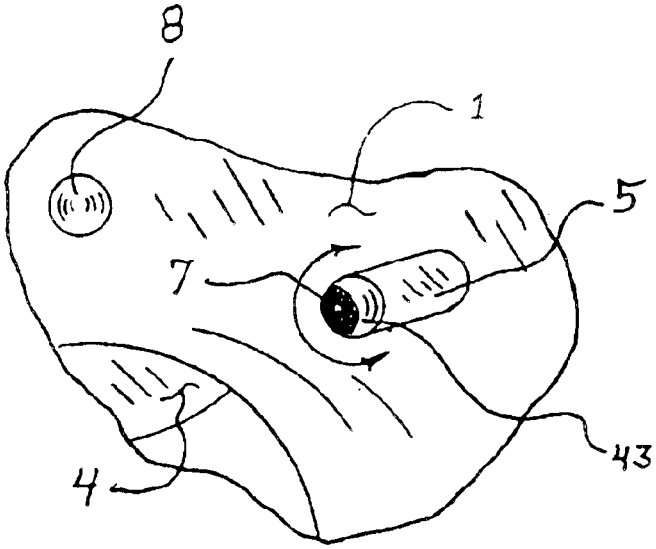
FIG. 2 shows a detailed view of one embodiment of the invention with the trigger lock in the no-fire position.
Figure 8:
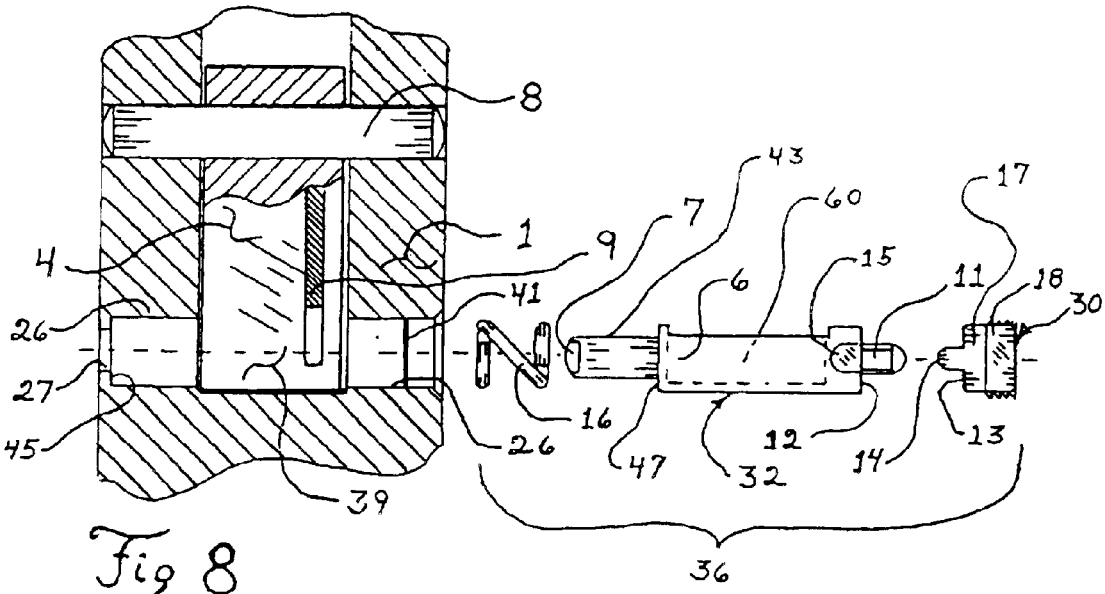
FIG. 8 shows an exploded view of elements of the trigger lock shown in partial cross section A—A from FIG. 9.

Referring to the drawings in detail wherein like elements are indicated by like numerals, there is shown in FIG. 1 a left side view of a handgun 34 and recessed cavity 5 containing an indicator shaft 43 and color indicator 7, FIG. 2, of a trigger lock 36, FIG. 8. Also visible in FIG. 1 is slide 2, trigger guard 3, ammo magazine 24, and magazine lock 25. The color indicator 7 indicates that the trigger lock is in the fire position. FIG. 2 shows a detailed view of the left side of handgun 34 with the shaft end 6 and color indicator 7 of the trigger lock 36, FIG. 8. In this figure the fire indicator 7 is in the no-fire position.

Figure 4:
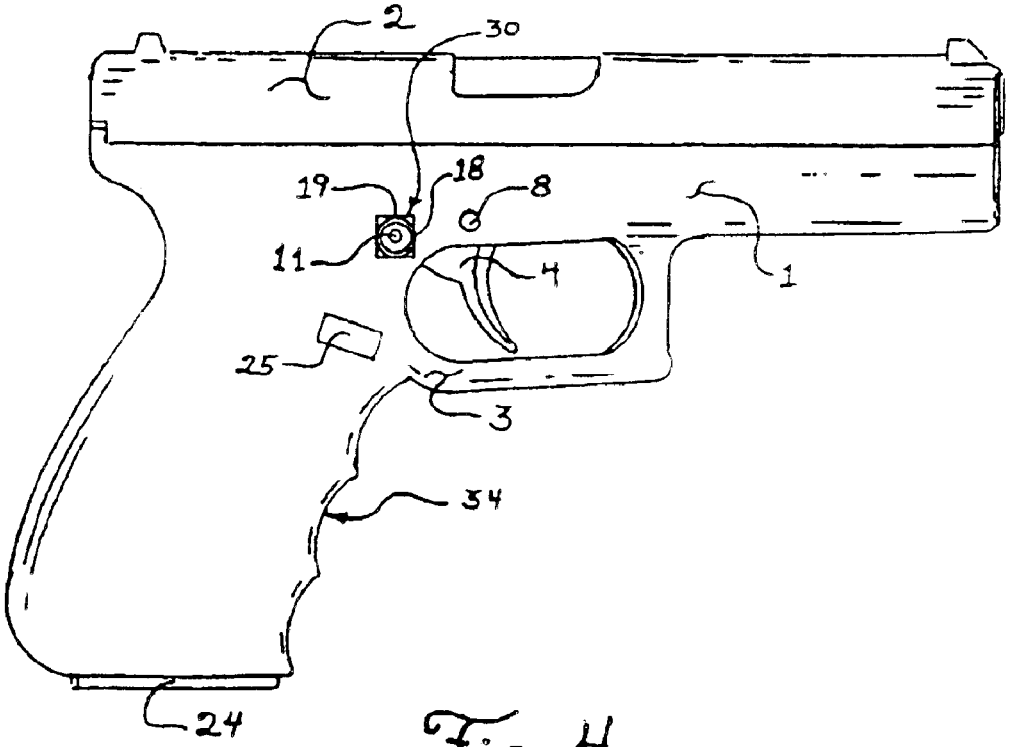
FIG. 4 shows a right side view of a handgun with one embodiment of the invention showing one location of the trigger lock device.
Figure 3:
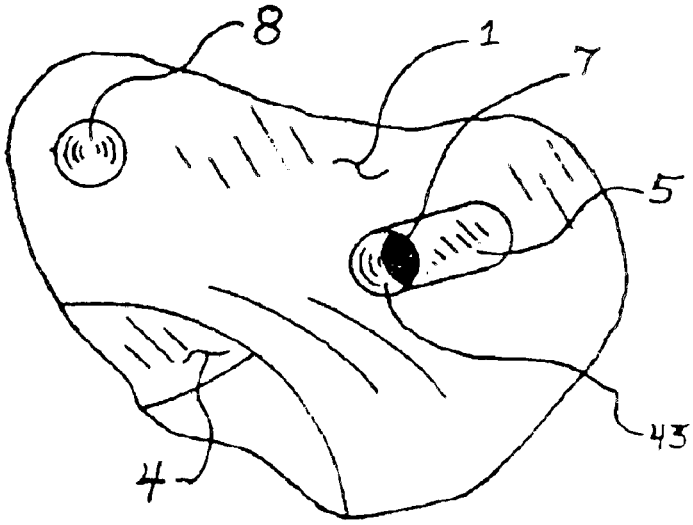
FIG. 3 shows a detailed view of one embodiment of the invention with the trigger lock in the fire position.

FIG. 4 shows the right hand side of handgun 34, the bushing 30 and work end 11 of the shaft 32 (not shown). FIG. 3 shows a detailed left side partial cutaway of handgun 34 indicator shaft 43 of shaft 32 and the color indicator 7 in the fire position.

Figure 5:
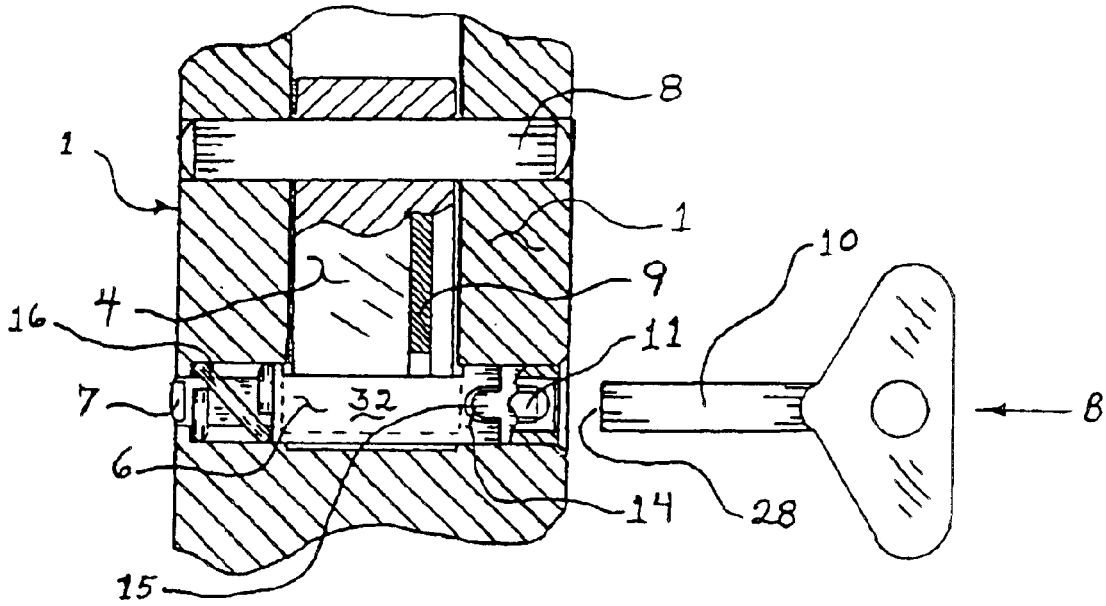
FIG. 5 shows a partial cross section generally shown along A—A in FIG. 9, with the trigger lock device in the fire position.
Figure 9:
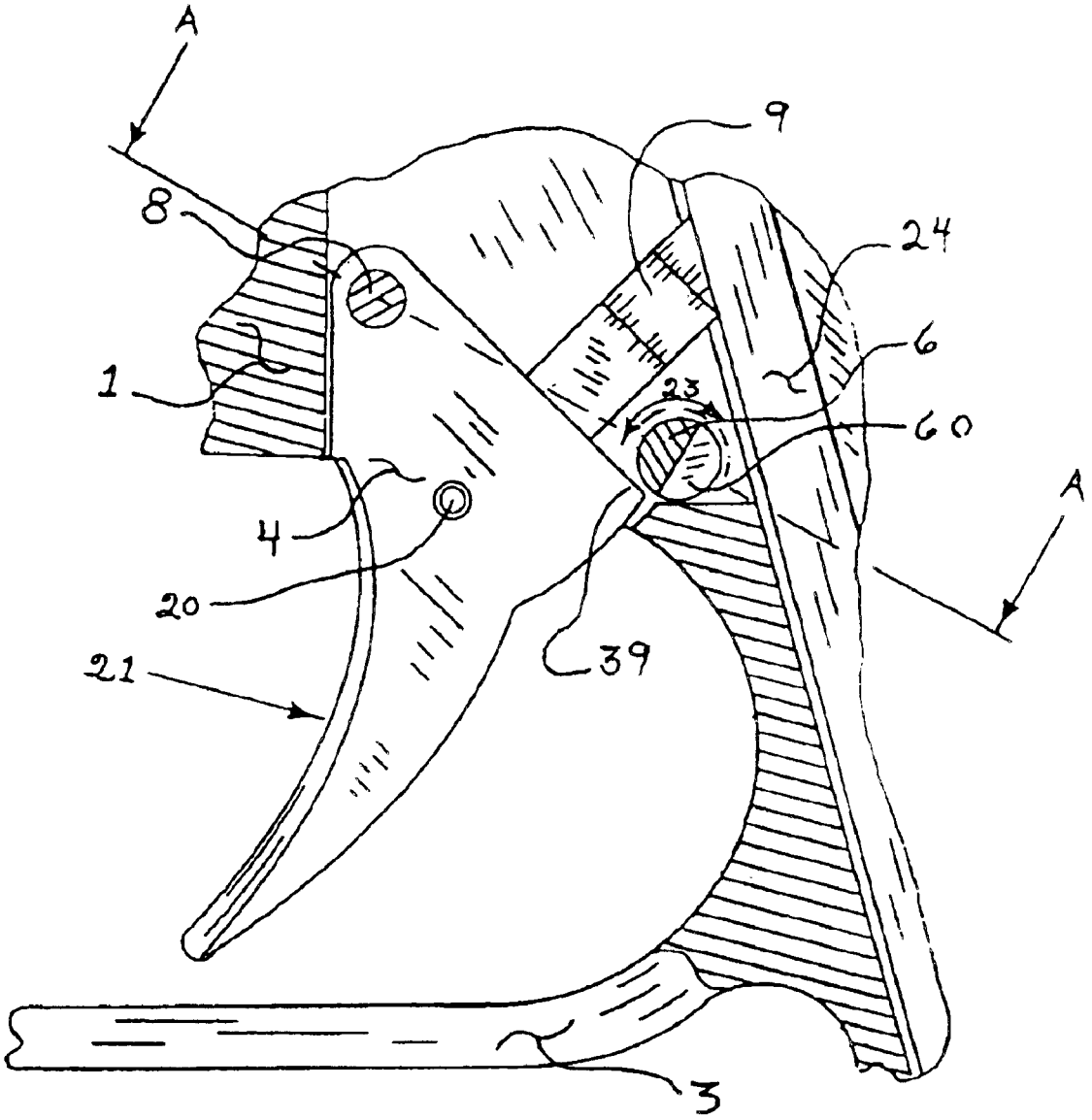
FIG. 9 shows a partial cross section view of the left hand side of the weapon showing the relative arrangement of elements of one embodiment of the invention and the trigger lock device in the no-fire position.

FIG. 5 shows a cutaway view along A—A in FIG. 9 of the trigger lock 36, FIG. 8, and related elements with the trigger lock 36 in the fire position. In FIG. 5, the trigger 4 could rotate away from trigger force 21 (FIG. 10) moving trigger linkage 9 in the direction of trigger rotation 22, FIG. 10, and trigger 4 would rotate around cross pin 8 to fire the weapon. FIG. 9 shows the triggering linkage pivot pin 20 and an arrow showing direction of rotation 23 of the shaft 32.

Figure 13:
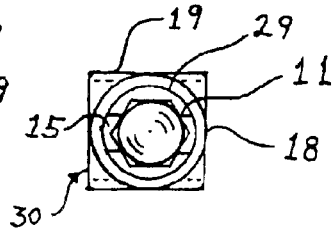
FIG. 13 shows one embodiment of the work end of the shaft assembled with the bushing.

The key 10 (FIG. 5) is used to engage the work end 11 of the shaft 32. The key 10 passes through the bore 29 (FIG. 13) of the bushing 30 to engage the work end 11 of the shaft 32. When the key 10 engages the work end 11 in direction "B", FIG. 5, this compresses spring 16 and the color indicator 7 and indicator shaft 43 can extend from the frame 1, FIG. 6. The indicator shaft 43 could be shortened or lengthened such that less or more could extend form the frame 1 when the key 10 biases the shaft 32 in the direction "B", FIG. 6.

While this particular embodiment shows a key 10 having a key end 28 matching a work end 11, other matching configurations are anticipated. Other common keys could be used with matching shaft 32 work end 11 such as a handcuff key or common key. Any other type of key devices known in the art could be utilized.

The bushing 30 is generally four sided on one end and round on an opposite end and has at least one set of serrations 19. The remaining sides can be smooth; see FIG. 14 where the round end is illustrated and has a round section 17 with a bushing contact surface 13. The serrations are needed to engage the frame 1 which in some embodiments is manufactured from a polymer. Other materials can be used depending on the materials used for the frame 1 in which case, the bushing 30 could utilize other methods of engagement with the frame 1. For example, the bushing 30 could be round all along the length and have threads (not shown) and any other methods of attachment to the frame 1 well known in the art.

Figure 6:
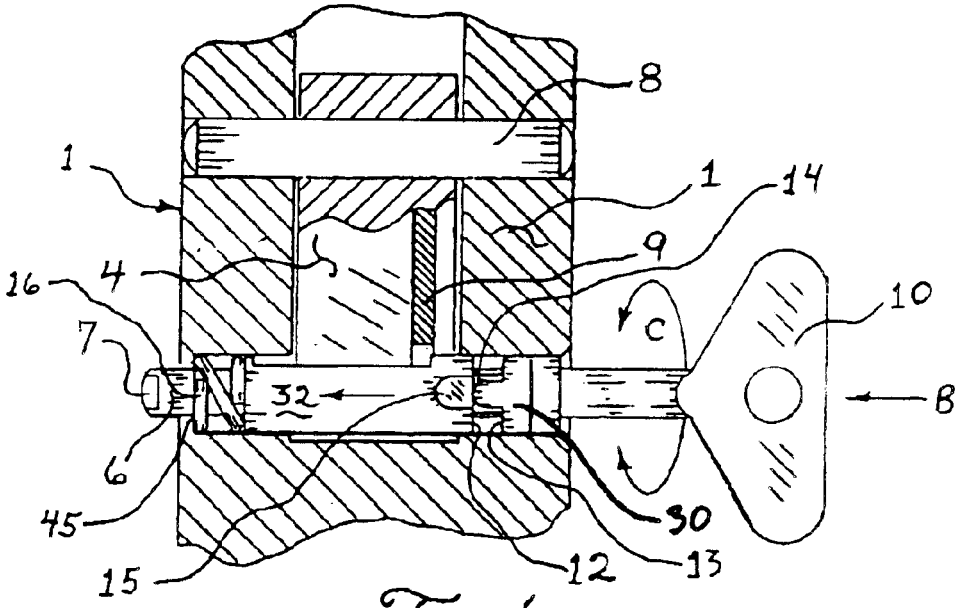
FIG. 6 shows a partial cross section generally shown along A—A in FIG. 9, with the key inserted and the trigger lock device in the no-fire position.

Once the key 10 biases the shaft 32, to the position shown in FIG. 6, the trigger 4 cannot move past the shaft 32, or the weapon is in the no-fire position. If the authorizes user biases the shaft 32 to the position shown in FIG. 6, the trigger 4 will not operate. Once the shaft 32 is depressed with key 10, the authorized user rotates the key 10, the shaft 32 turns from the fire position shown by color indicator 7 of FIG. 3 and position of shaft 32. FIG. 5, to the no-fire position shown by color indicator 7 of FIG. 2 and position of shaft 32, FIG. 7. The shaft 32 can be tuned in either the clockwise or counter clockwise direction to either the fire or no-fire position.

It should be noted that once the shaft 32 is translated or rotated form the fire position, the weapon trigger 4 is in the no-fire position. This continues until the shaft 32 is returned to the position, both angular and linear, shown in FIG. 5.

Figure 12:
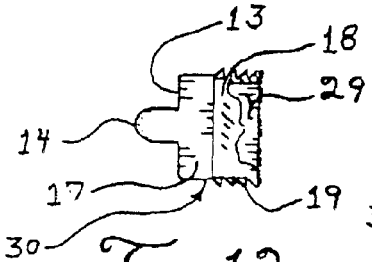
FIG. 12 shows a side detailed view of one embodiment of the bushing of the present invention.
Figure 14:
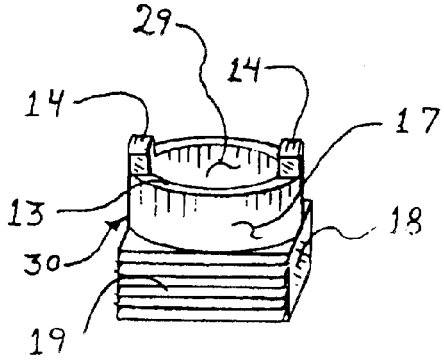
FIG. 14 shows a perspective view of one embodiment of the bushing.

Once the shaft 32 is translated to the position shown in FIG. 6 and rotated a preset amount, the user could release the pressure on the key 10 and shaft 32 would bias to the position such that the bushing ears 14, FIGS. 12, 14, would contact the contact surface 12, FIG. 8. This embodiment shows two bushing ears 14, FIG. 14, approximately 180 degrees apart and two corresponding shaft cavities 15, FIG. 8—only one shown. It is to be understood that more or fewer bushing ears 14 and corresponding number of shaft cavities 15 could be utilized and still fall within the scope of this disclosure.

Figure 7:
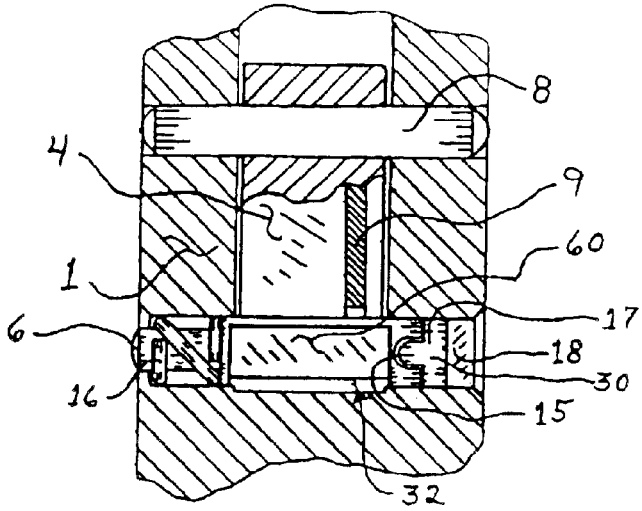
FIG. 7 shows partial cross section along A—A in FIG. 9 with the trigger lock device in the no-fire position.

The bushing ears 14, would ride along contact surface 12 until the bushing ears 14 engaged the shaft cavities 15 of shaft 32, FIGS. 7, 8. At this point the spring 16 biases the shaft 32 such that the bushing ears 14 are engaged within the shaft cavities 15 and the trigger lock 36 is in the no-fire position FIG. 7. The bushing ears 14 are on opposite sides of the bore 29 best shown in FIGS. 13, 14.

If the user rotates the shaft 32 a preset amount, the shaft 32 will prevent the trigger 4 from firing. The trigger 4 can only be fired if the shaft 32 is in the proper orientation with respect to the trigger 4 and the bushing ears 14 are engaged within the cavities 15. This provides for the greatest number of no-fire positions, or once the authorized user inserts the key, all translation and rotation of the key results in the trigger lock 36 being in the no-fire position. There is only one angular position where the trigger look 36 will allow the weapon to fire.

Figure 10:
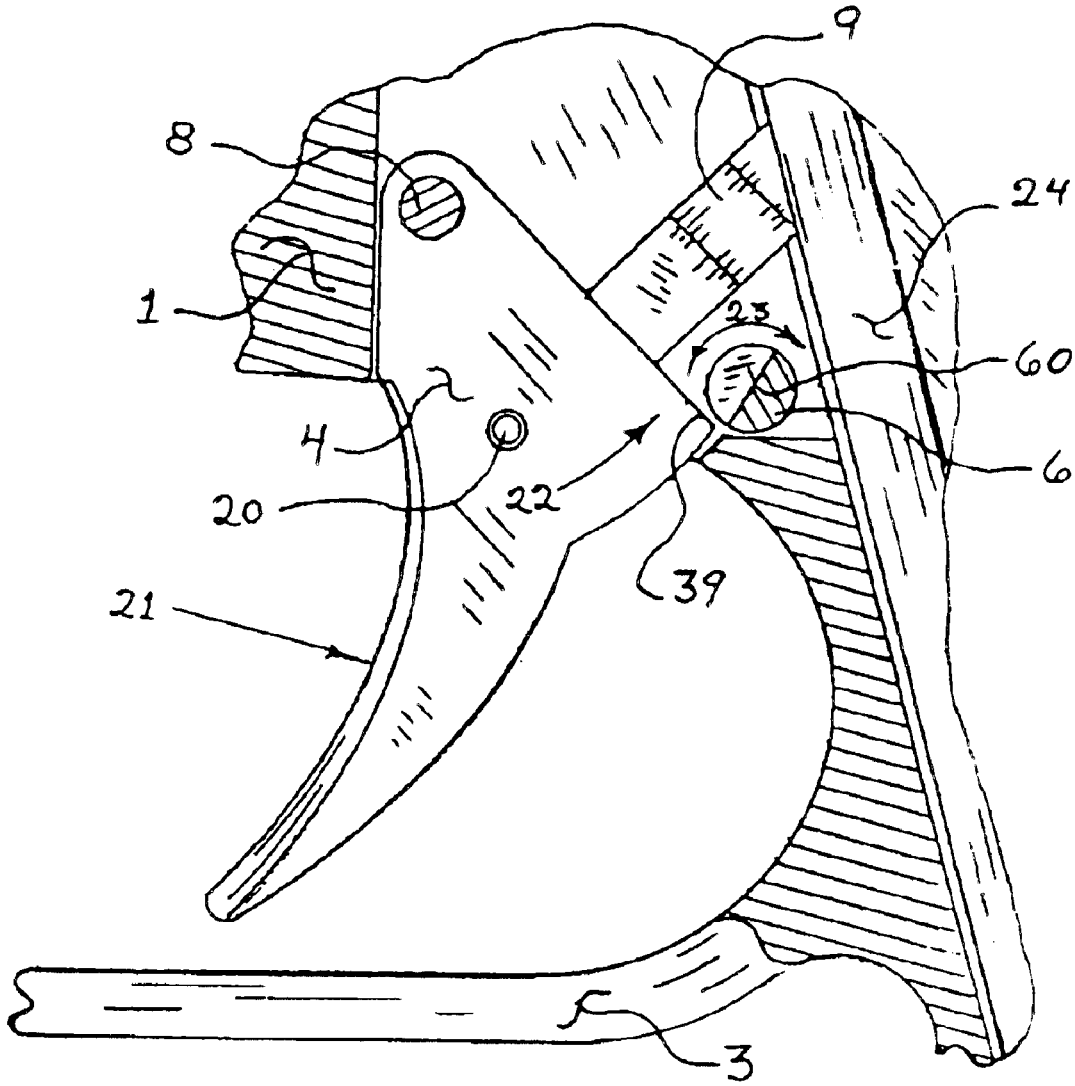
FIG. 10 shows partial cross section view of the left hand side the weapon showing the relative arrangement of elements of one embodiment of the invention and the trigger lock device in the fire position.
Figure 11:
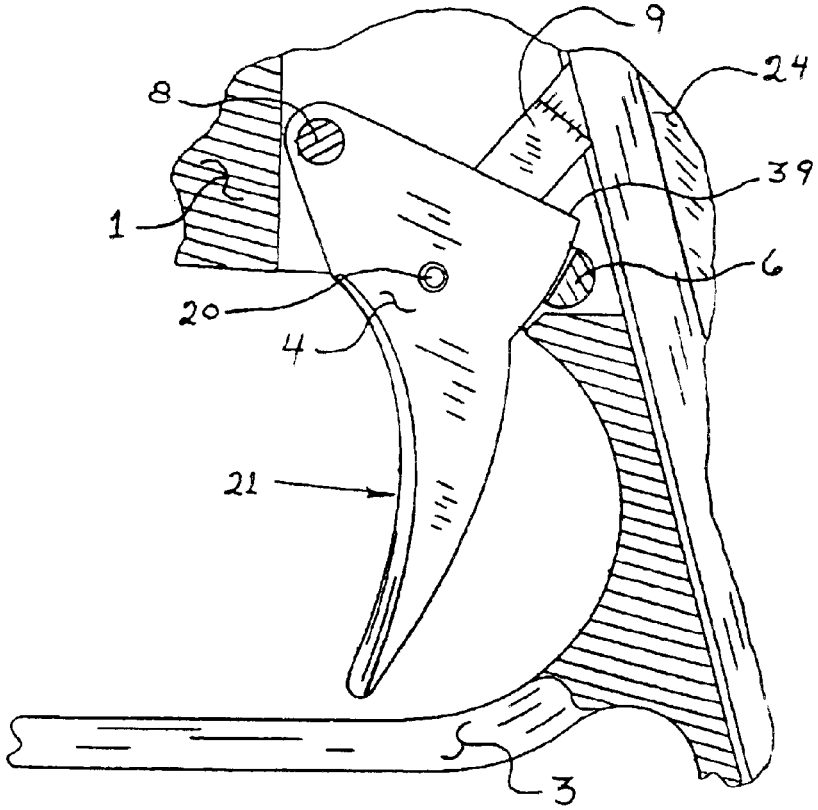
FIG. 11 snows partial cross section view of the left hand side of the weapon showing arrangement of elements of one embodiment of the invention with the trigger depressed and the trigger lock device in the fire position.

While this embodiment shows a shaft 32 where approximately one half of the of the shaft is removed to allow the trigger 4 trigger surface 39 to pass and operate. FIGS. 8, 10 & 11, less material could be removed from the shaft 32. In other words, the orientation of the shaft 32 to the trigger 4 could be adjusted such that a small portion of the shaft 32 could be removed requiring a very specific orientation of the shaft 32 relative to the trigger 4 to allow the trigger 4 to fire. This would provide for a larger no-fire rotational orientation of the shaft 32 resulting in the trigger 4 being in a no-fire position and a smaller rotational orientation of the shaft 32 resulting in the trigger 4 being in a fire position. Other embodiments of this invention could also utilize a cam (not shown) on the trigger 4 and a slot (not shown) in the shaft 32 where the weapon would only fire if the cam and slot were aligned and various other methods can be anticipated.

The location of the cutout 60 (FIG. 7) of the shaft 32 could also be angularly adjusted relative to the bastion of the bushing ears 14 and corresponding shaft cavities 15. This provides for many different possible angular combinations of the shaft 32, bushing ears 14 and cavities 15, to put the trigger look 36 into a fire position from a no-fire position and vice-versa.

Even if an authorized user were able to obtain the key, they would have to know to bias the shaft 32 away from the bushing 30 and then rotate the shaft 32 the appropriate angular amount. They would then have to release the bias on the shaft 32 such that the bushing ears 14 engage the shaft cavities 15 in the correct orientation of the shaft 32 relative to the trigger 4, to get the trigger 4 of the handgun 34 to operate.

ASSEMBLY

To assemble the trigger lock 36 in the frame 1 requires that there be holes in the frame. These holes can either be included during the manufacture of the frame 1, or cut in the frame at a later time. The trigger lock 36 and spring 16 would be inserted from the right hand side of the weapon, FIG. 8, into the shaft bore 26 until the spring 16 engages both the retainer 47 and the shoulder 45. It should be noted that the trigger lock 36 could be inserted from the opposite side of the weapon too by mirror imaging the relating structure, should the user prefer to have it configured in this manner. FIG. 8 shows a square hole terminating at shoulder 41 in the frame 1. This corresponds with the flat side 18 of the bushing 30, FIG. 14. This shoulder 41 prevents the bushing 30 from being inserted too far into the frame 1 and also allows for the proper alignment and operable configuration of the trigger lock 36 and trigger 4 and trigger surface 39.

The spring 16 is inserted over the indicator shaft 43. The shaft 32 is then inserted into the frame 1 from the right hand side such that the spring 16 engages the shoulder 45, FIG. 8, near shaft end bore 27. The bushing 30 is then inserted in the right side and aligned in the hole and pressed into the frame 1 such that the flat side 18 abuts shoulder 41. The serrations 19 on bushing 30 engage the frame 1 and discourage the removal of the bushing 30 and other elements from the frame 1.

Second Embodiment

Figure 16:
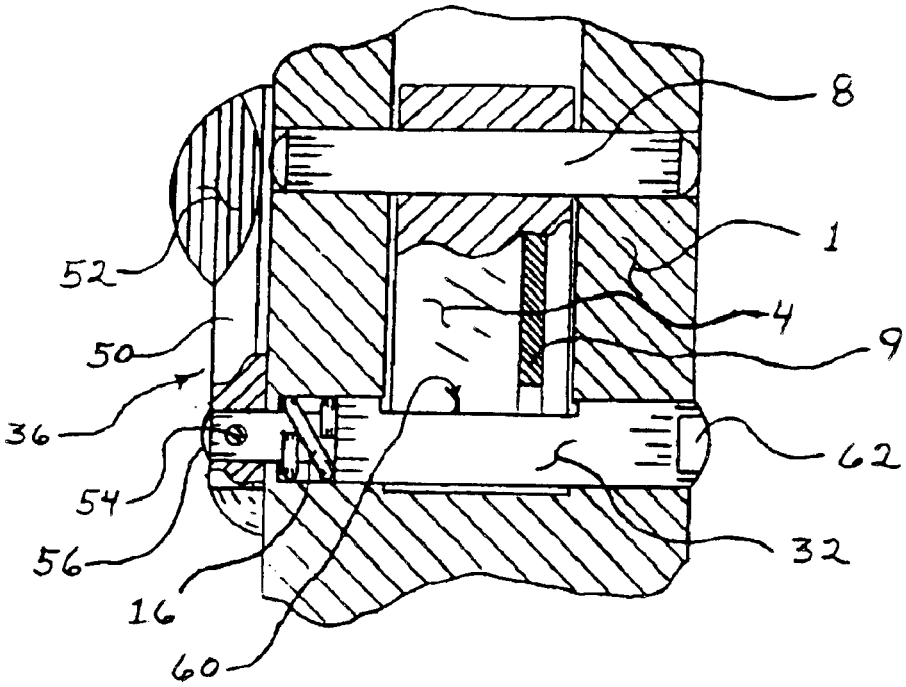
FIG. 16 shows a partial cross section generally shown along A—A of a second embodiment of the invention with a thumb lever.
Figure 15:
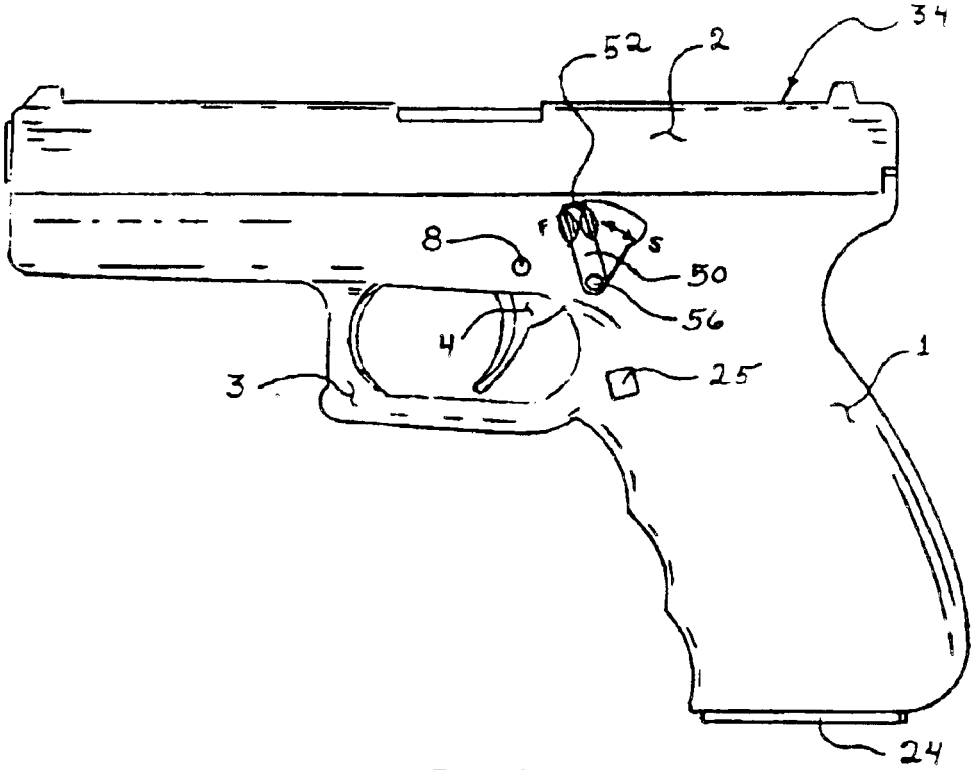
FIG. 15 shows a side view of one embodiment of a handgun with a thumb lever.

Another embodiment of the trigger lock 36 is shown in FIGS. 15 & 16. In this embodiment, a thumb lever 50 is attached to the rod 56 of the shaft 32 with a pin 54 or other attachment method. The lever 50 and the shaft 32 can be reversed for the right hand or left hand user. FIG. 15 shows the lever 50 positioned on the left side of the handgun 34 for the right handed user.

The shaft 32 rotates relative to the frame 1 when the user engages the thumb pad 52 on the end of thumb lever 50. Rotating the thumb lever 50 causes the shaft 32 and cutout 60 to rotate. In one position of the thumb lever 50 and thumb pad 52, as shown in FIG. 15, the trigger 4 and triggering linkage 9 can clear the cutout 60 when the trigger 4 is pulled. In this position, the trigger will operate. Rotating the thumb lever 50 towards the butt end of the handgun 34, causes the shaft 32 to rotate such that cutout 60 is positioned where the trigger 4 and triggering linkage 9 cannot move and engage the shaft 32. The handgun 34 is in the no-fire, or no-operation position A first end 62 can like wise be on the shaft 32 and visible on the weapon on the side opposite the thumb lever 50, or contained within the frame 1. The spring 16 can be used to retain the trigger lock 36 in the frame.

While this embodiment is shown installed in a hand gun 34, it should be understood that this embodiment could be installed in any device that uses a trigger 4 and has a need to be set in a fire and no-fire position, or operate and no-operate position.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

I claim:

1. A trigger lock housed in a frame, the trigger lock for preventing the operation of a trigger in a no-fire position and allowing the operation of a trigger in a fire position, the trigger lock comprising:

a shaft having a first end and a rod on an opposite end, a cutout located between the first end and the rod, the shaft rotatable within the frame;

a spring for retaining the shaft within the frame;

a thumb lever for attachment to the rod of the shaft; and where pressing the thumb lever in one direction causes the shaft to rotate so that the cutout is near the trigger and the trigger will operate and pressing the thumb pad in an opposite direction causes the shaft to rotate so that the cutout is not near the trigger and the trigger will not operate.

2. The trigger lock of claim 1, further comprising:

a thumb pad on the lever.

3. The trigger lock of claim 1, further comprising:

a pin for attaching the thumb lever to the shaft.

4. A trigger lock housed in a frame, the trigger lock for preventing the operation of the trigger in a first position and allowing the operation of the trigger in the second position, the trigger lock comprising:

a shaft having a first end and a rod on a second end, a cutout from the shaft located between the first end and the rod;

a spring around the shaft near the rod end for engaging the frame and shaft and retaining the shaft within the frame;

a thumb lever attached to the shaft; and where the rotation of the thumb lever causes the shaft to rotate such that the shaft prevents the operation of the trigger and rotation of the thumb lever in another direction causes the shaft to rotate such that the cutout allows the trigger to operate.

5. The trigger lock of claim 4, further comprising:

a thumb pad on the lever.

6. The trigger lock of claim 4, further comprising a pin for attaching the thumb lever to the shaft.

* * * * *